United States Patent [19]

Thrasher

[11] 4,253,943

[45] Mar. 3, 1981

[54] CONTINUOUS FLOW CLASSIFICATION AND SPECIFIC GRAVITY SEPARATION APPARATUS

[76] Inventor: Donald D. Thrasher, R.D. #1, North Manchester, Ind. 46962

[21] Appl. No.: 135,683

[22] Filed: Mar. 31, 1980

[51] Int. Cl.[3] ..... B03B 5/04; B03B 5/06; B03B 7/00

[52] U.S. Cl. ..... 209/44; 209/458; 209/437; 209/506

[58] Field of Search ..... 209/44, 13, 437, 458, 209/440–443, 460, 506

[56] References Cited

U.S. PATENT DOCUMENTS

| | | | |
|---|---|---|---|
| 492,057 | 2/1893 | Simonson | 209/458 X |
| 1,044,373 | 11/1912 | Gilchrist | 209/460 |
| 1,218,977 | 3/1917 | Burnhart | 209/441 |
| 1,894,779 | 1/1933 | Mitchell | 209/44 |
| 3,292,781 | 12/1966 | Kjarval | 209/44 |
| 4,199,441 | 4/1980 | Ross | 209/44 |

*Primary Examiner*—Ralph J. Hill
*Attorney, Agent, or Firm*—Gust, Irish, Jeffers & Hoffman

[57] ABSTRACT

Apparatus for continuous flow classification and specific gravity separation of relatively fine, heavy sands from gravel and dirt aggregate comprises an elongated channel having an apertured top plate which defines an upwardly facing flume and a cavity. The flume is adapted to have a flow of water bearing the aggregate introduced at its upstream end to flow over the top plate so that the relatively smaller, heavier material falls through the apertures into the cavity. An inclined table is positioned in the cavity below the top plate, the angle of inclination of the table being adjustable. The table has a trough defining side portions and terminating in a downstream extension for discharging tailings, the extension having an opening communicating with the sump portion of the cavity. An adjustable weir diverts flow of a selected heavier portion of the material from the trough into the cavity sump. Riffles are provided on the table side portions under the top plate apertures, the width of the spaces between the riffles being narrower than the width of the riffles. The riffles have a selectively adjustable downstream inclination. Means are provided for selectively introducing an additional flow of water at the upstream end of the cavity between the table and top plate. Additional riffles are provided at the bottom of the trough, and a Venturi is provided for removing separated heavier sands from the cavity sump.

25 Claims, 16 Drawing Figures

230
220
24
216
214
232
198
234
83
236
242
244
218
85
222
26
238
226
240
224
248
246
228

CONTINUOUS FLOW CLASSIFICATION AND SPECIFIC GRAVITY SEPARATION APPARATUS

BACKGROUND OF THE INVENTION

1. Field of the Invention

This invention relates generally to classification apparatus used in placer mining operations, and more particularly to continuous flow apparatus for classification and specific gravity separation of relatively fine, heavy sands, particularly precious metal-bearing sands, from gravel and dirt aggregate.

2. Description of the Prior Art

Precious metals, such as gold, have been recovered from river bed gravel formations by the use of sluice boxes. A conventional sluice box comprises an elongated channel or trough having spaced, upstanding, transversely extending barriers or "riffles" on its bottom, the width of the spaces between the riffles conventionally being much greater than the thickness of the riffles, and each riffle commonly having a flange on its top edge which extends in the downstream direction. The sluice box is inclined and a stream of water is caused to flow therein with the gravel from which the precious metal is to be recovered being introduced at the upper end. The flow of water carries the lighter materials over the riffles whereas, the heavier gold-bearing sands accumulate behind the riffles and are periodically removed therefrom. The lighter and larger components of the gravel aggregate discharged from the sluice box are referred to as "tailings". Conventional classification apparatus commonly referred to as "grizzley", which merely separates or "classifies" smaller from larger particulate material, has commonly been employed ahead of a sluice box, in order preliminarily to remove the larger components of the aggregate.

Prior apparatus for recovering precious metals; i.e., conventional sluice boxes and classification apparatus, has been inefficient in that the tailings have included a considerable quantity of heavier, gold-bearing sands. In the past, efforts to recover on a continuous flow basis a higher proportion of the fine, heavy gold-bearing sands have been largely unsuccessful. Further, in the past, economics has not warranted recovery of the gold contained in such tailings, nor has it warranted efforts to recover gold from river bottoms having a lower gold content.

The dramatic increase in the price of gold and other precious metals now makes it desirable to provide more efficient apparatus for rapidly separating relatively fine, heavy precious metal-bearing sands from gravel and dirt aggregate in a continuous flow manner, and it is further desirable to provide such apparatus which is readily adjustable to accomodate varying types of aggregates having varying precious metal contents, and different rates of water flow.

SUMMARY OF THE INVENTION

The invention in its broader aspects, comprises an elongated channel structure having spaced, opposite side walls, spaced upstream and downstream ends, and a bottom wall. A top plate member is provided spaced from the bottom wall, extending laterally between the side walls and longitudinally between the ends of the channel, the top plate member having top and bottom surfaces with the bottom surface defining a longitudinally extending cavity with the side and bottom walls, and the side walls having portions extending from the top surface of the top plate member and defining a flume therewith extending longitudinally between the upstream and downstream ends of the channel. The top plate member has at least a portion thereof extending longitudinally toward the downstream end with a plurality of closely-spaced apertures formed therethrough which communicate with the cavity. The channel has a back wall extending from the bottom wall to the top plate member and between the side walls at the upstream end. The flume is adapted for the introduction of a flow of water bearing the aggregate adjacent the upstream end for flow over the top surface of the top plate member toward the downstream end so that the relatively smaller, heavier material forming a part of the aggregate falls through the apertures into the cavity along with some of the water.

A longitudinally extending table is provided in the cavity spaced below the top plate member, the table being inclined downwardly from adjacent the upstream end toward the downstream end with its side edges respectively adjacent the side walls of the channel. Means are provided for selectively adjusting the angle of inclination of the table. The table has a trough formed therein extending longitudinally between the upstream and downstream table ends intermediate at side edges and respectively defining side portions of the table. The trough has a bottom, and the table includes an extension portion of its downstream end for discharging tailings therefrom, the extension portion extending generally from the trough bottom and having an opening therein adjacent the downstream table end communicating with the sump portion of the cavity below the extension portion for discharging the heavy sands thereto. Weir means are provided for diverting flow of a selected heavier portion of the sands at the bottom of the trough through the opening into the cavity sump portion, while permitting the flow of the remaining lighter portion of the sands over the weir means onto the extension portion. Means are provided for selectively adjusting the weir means, thereby to select the heavier sand portion desired.

Longitudinally extending baffle means is provided over the trough for diverting material and water falling through the apertures onto the table side portions. Riffle means is provided on each of the table side portions under the top plate member apertures for receiving the material and water falling therethrough and for separating the heavier material therefrom, the riffle means respectively extending laterally from the side table edges to the trough and being respectively inclined downstream from the table side edges toward the trough for carrying the heavier sands thereto. Means is provided for selectively adjusting the angle of inclination of the riffle means. Means is provided for selectively introducing an additional flow of water into the cavity adjacent the upstream table end and between the table end and between the table and the top plate member for flow over the riffle means, and in the trough toward the downstream table end, and means is provided for removing the separated heavier sand from the cavity sump portion.

It is accordingly an object of the invention to provide improved continuous flow apparatus for classification and specific gravity separation of relatively fine, heavy sands from gravel and dirt aggregate.

Another object of the invention is to provide improved continuous flow apparatus for the rapid classification and specific gravity separation of relatively fine, heavy sands from gravel and dirt aggregate and which is readily adjustable to accomodate different types of aggregate having different contents of heavy sand, and different rates of water flow.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
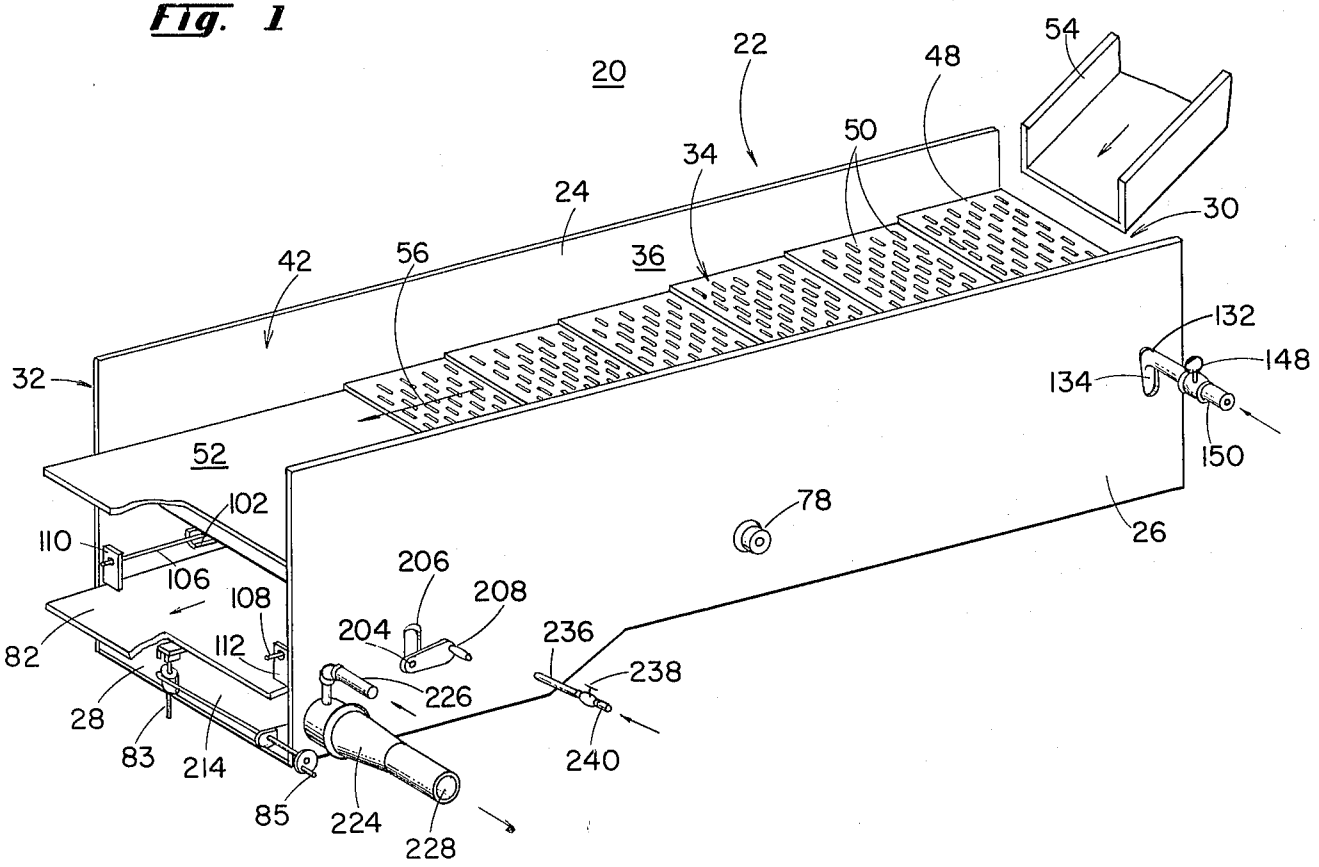
FIG. 1 is a perspective view showing the preferred embodiment of the apparatus of the invention.

Referring now to FIG. 1 of the drawings, the preferred embodiment of the continuous flow classification and specific gravity separation apparatus of the invention, generally indicated at 20 comprises an elongated channel or box structure 22 having upstanding, spaced, opposite side walls 24, 26, bottom wall 28, and upstream and downstream ends 30, 32.

Figure 2:
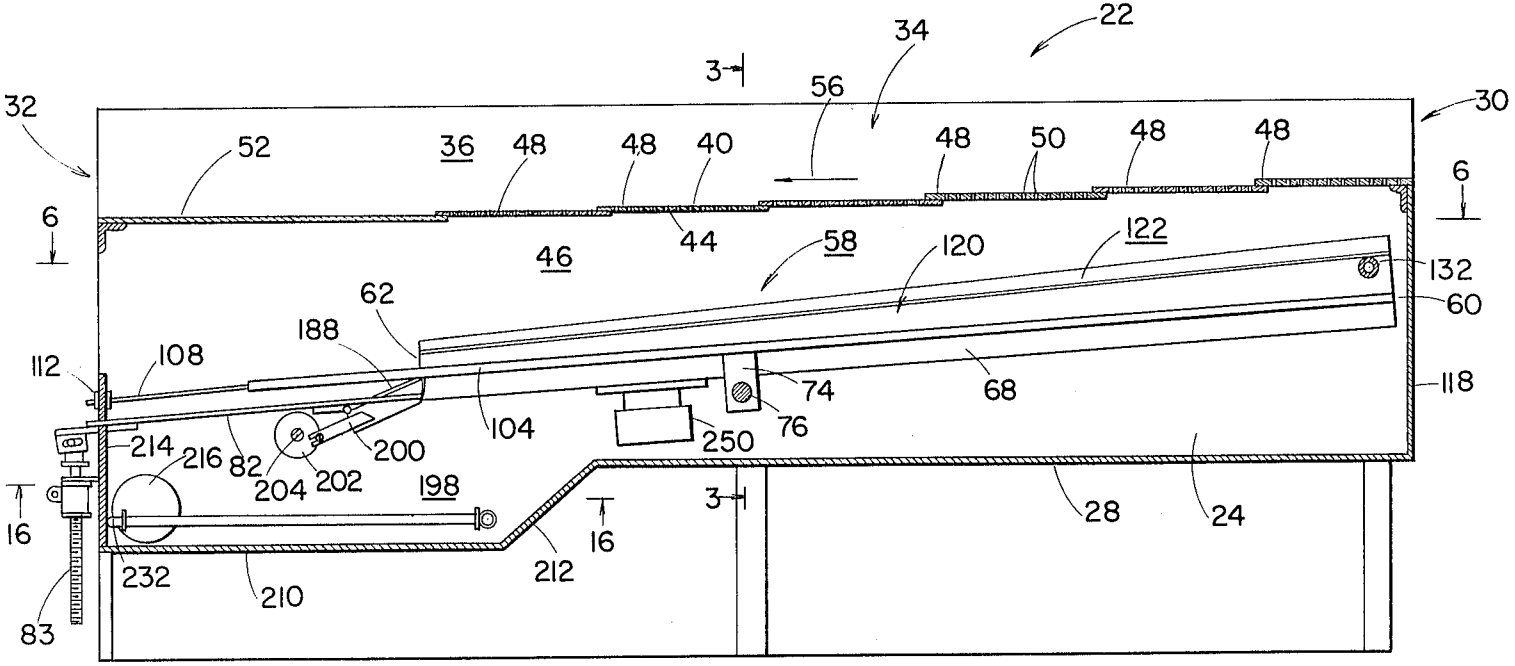
FIG. 2 is a side cross-sectional view of the apparatus of FIG. 1.

Top plate member 34 extends laterally between side walls 24, 26, longitudinally between upstream and downstream ends 30, 32, and is spaced above bottom wall 28. Side walls 24, 26 have portions 36, 38 upstanding from top surface 40 of top plate 34 to define flume 42. Bottom surface 44 of top plate 34 defines cavity 46 with side walls 24, 26 and bottom wall 28. Top plate member 34 preferably is formed of a plurality of sections 48 descending in step-fashion from upstream end 30 toward downstream end 32, as best seen in FIG. 2.

Figure 5:
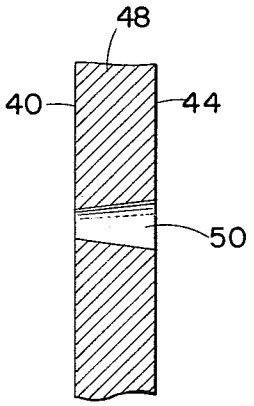
FIG. 5 is a fragmentary cross-sectional view taken generally along the line 5—5 of FIG. 4.

Each of sections 48 has a plurality of transversely elongated apertures 50 formed therein, each of the apertures 50 being divergently tapered from top surface 40 to bottom surface 44 as best seen in FIG. 5. The final, downstream section 52 of top plate member 34 is imperforate.

A stream of water bearing the gravel and dirt aggregate is introduced to the upstream or head end 30 of flume 42 by a main sluice box 54 for flow over top plate member 34 from upstream end 30 toward downstream or tail end 32, as shown by arrow 56. It will be understood that in flowing over top plate member 34, the smaller components of the aggregate, and in particular the heavy sands, along with some water, fall through apertures 50 into cavity 46, the remaining larger components of the sand and gravel being discharged as tailings from downstream end 32. The divergent taper of apertures 50, as shown in FIG. 5, inhibits clogging or binding of apertures. In a specific embodiment, the opening of apertures 50 at top surface 40 of top plate sections 48 ranges from 1/16th to 3/32nds inch.

Figure 3:
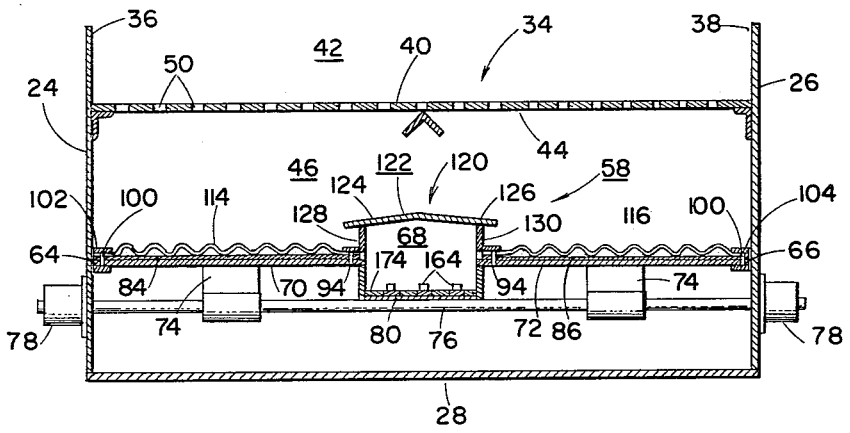
FIG. 3 is a cross-sectional view taken generally on a line 3—3 of FIG. 2.
Figure 4:
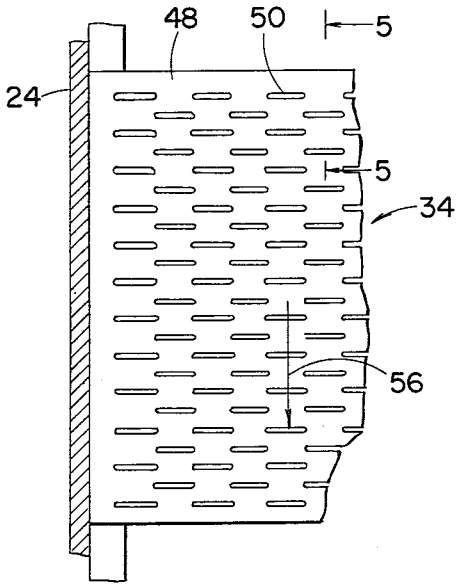
FIG. 4 is an elongated, fragmentary top view showing a segment of one top plate section.

Table 58 is positioned in cavity 46 beneath top plate member 34. Table 58 is inclined from its upstream end 60 toward its downstream end 62. Table 58 has side edges 64, 66 respectively adjacent side walls 24, 26 and trough 68 extending longitudinally from end 60 to end 62 intermediate side edges 64, 66 to define table side portions 70, 72 (FIG. 3).

Trunion bearings 74 support shaft 76 journaled in bearings 78 on side walls 24, 26, thereby pivotally to support table 58 in order selectively to adjust its angle of inclination, as will hereinafter be described. Trough 68 includes bottom 80 and extension portion 82 extends in the downstream direction from table 58 generally coplanar with bottom 80. An adjustable screw 83 actuated by crank 85 acts on table extension 82 (FIGS. 1 and 2) in order to selectively adjust the angle of inclination of table 68.

Figure 6:
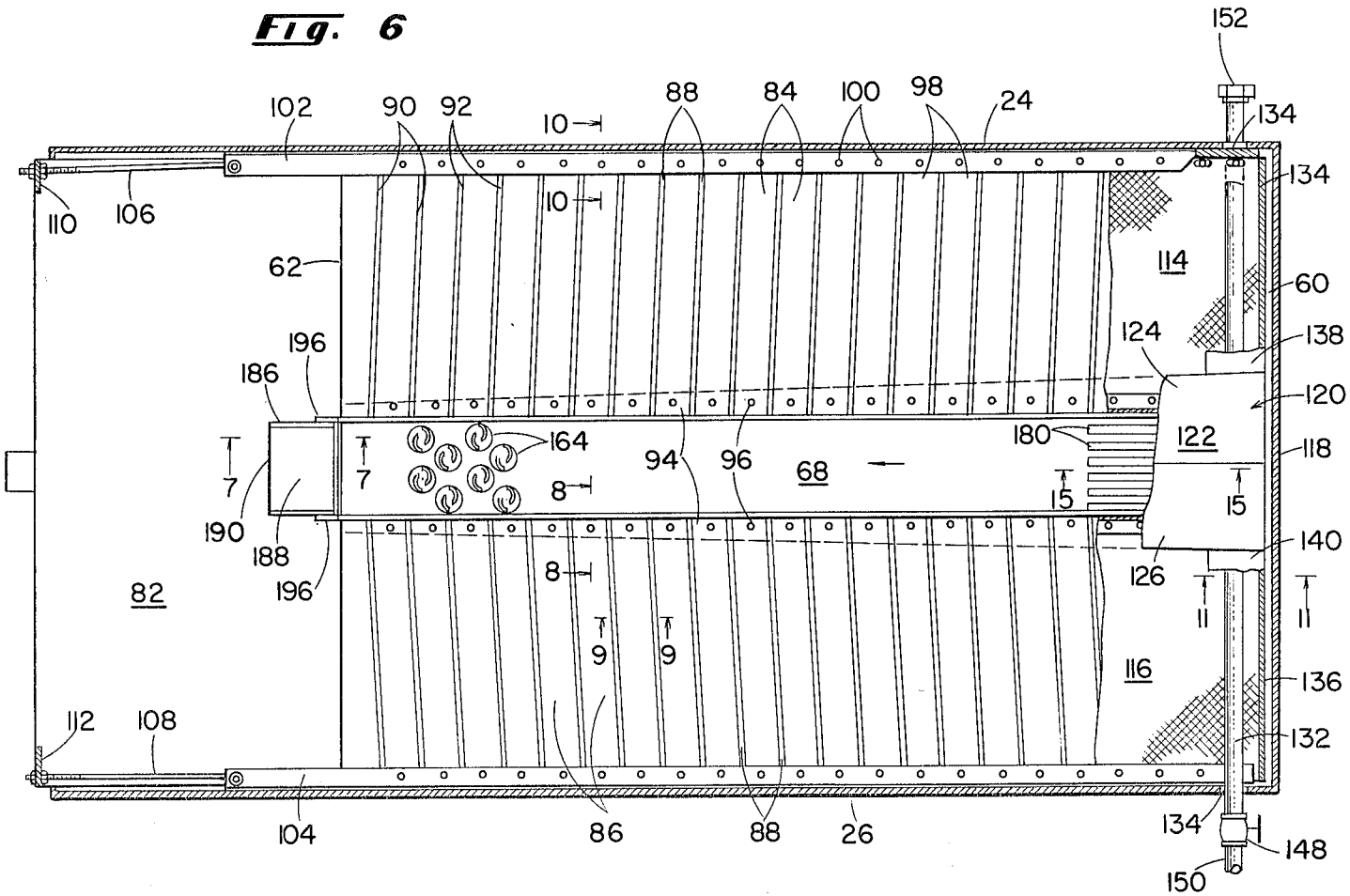
FIG. 6 is a top view, partly in cross section and partly broken away, taken generally along the line 6—6 of FIG. 2.
Figure 10:
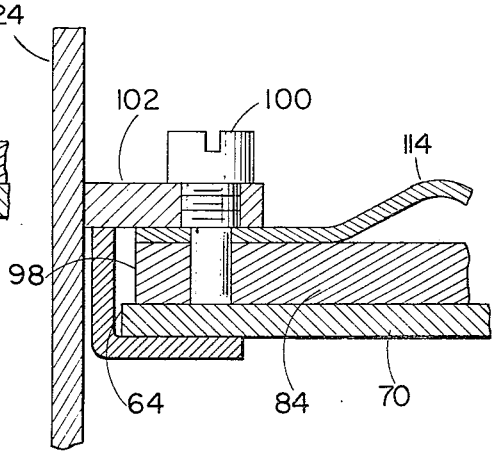
FIG. 10 is a fragmentary cross-sectional view taken generally along the line 10—10 of FIG. 6.
Figure 9:
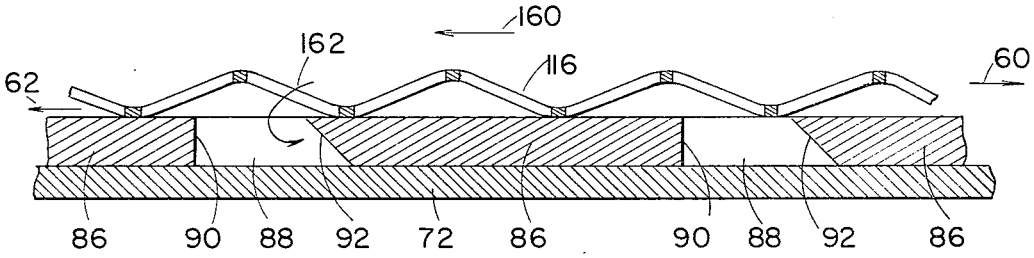
FIG. 9 is a fragmentary cross-sectional view taken generally along the line 9—9 of FIG. 6.

A plurality of spaced, parallel, laterally extending riffle members 84, 86 are positioned on side portions 70, 72 of table 58. As best seen in FIG. 9, the width of riffle members 84, 86 is substantially greater than the width of the spaces or slots 88 therebetween. Upstream facing edges 90 of riffle members 84, 86 are substantially perpendicular to the respective side portions 70, 72 of table 58 whereas, downstream facing edges 92 are inclined upwardly in the downstream direction, as shown in FIG. 9. Riffle members 84, 86 with slots 88 therebetween are inclined in the downstream direction from adjacent walls 24, 26 to trough 68 as best seen in FIG. 6. Riffle members 84, 86 have their inner ends 94 adjacent trough 68 respectively pivotally connected to side portion 70, 72 of table 58 as at 96, and their outer ends 98 respectively adjacent side walls 24, 26 pivotally connected by side bars 102, 104 (FIGS. 6 and 10).

The angle of inclination of riffle members 84, 86 and slots 88 is selectively adjusted by rods 106, 108 respectively connected to bars 102, 104 and having a threaded connection with members 110, 112 on table extension 82 (FIG. 6).

Expanded metal screens 114, 116, respectively, cover riffle members 84, 86. Inspection of FIG. 2 will show that the apertured sections 48 of top plate member 34 overlay table 58, and that the imperforate section 52 overlays table extension 82.

Figure 8:
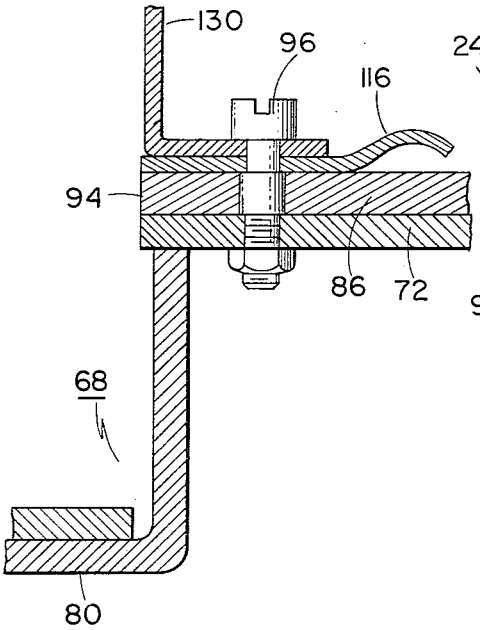
FIG. 8 is a fragmentary cross-sectional view taken generally along the line 8—8 of FIG. 6.

Back wall 118 extends laterally between side walls 24, 26 and upwardly from bottom wall 28 to top plate 34 at upstream end 30 of channel 22. Baffle assembly 120 covers trough 68 of table 58 and comprises peaked roof portion 122 defining side sections 124, 126, respectively, tapering toward side walls 24, 26. Roof 122 is spaced above trough 68 by upstanding walls secured by pivot members 96 (FIG. 8). Roof 122 of baffle assembly 120 deflects water and material falling through apertures 50 in top plate 34 laterally onto screens 114, 116 (FIG. 3).

Figure 11:
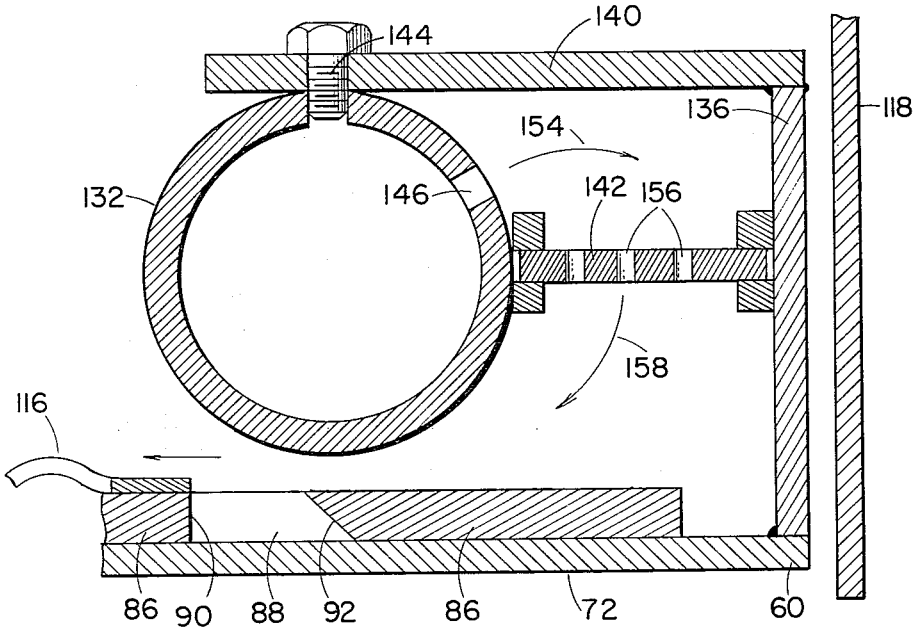
FIG. 11 is a fragmentary cross-sectional view taken generally along the line 11—11 of FIG. 6.

Conduit 132 is secured to table 58 at its upstream end 60 (FIG. 11), extending laterally between top plate 34 and table 58, and outwardly through slots 134 in side walls 24, 26, slots 134 accommodating the tilting adjustment of the angle of pitch of table 58. Plates 134, 136 extend upwardly from table side portions 70, 72, respectively, at upstream end 60, and plates 138, 140 are secured to the top edges of plates 134, 136, as by welding, and extend in the downstream direction (FIGS. 6 and 11). Conduit 132 is secured to plates 136, 140 by plate 142 and threaded fasteners 144 (FIG. 11). Conduit 132 has spaced apertures 146 formed therein which angle upwardly in the upstream direction, as best seen in FIG. 11. Valve 148 couples conduit 132 to source 150 of water under pressure, such as 175 psi. The other end of conduit 132 is capped, as at 152, it being understood that the positions of valve 148 and cap 152 may be reversed, as desired.

Referring particularly to FIG. 11, the water sprayed from openings 146 is deflected by plates 138, 140 onto plate 142, as shown by arrow 154. Plate 142 has a plurality of openings 156 therein, permitting the water from conduit 132 to flow downwardly and in the downstream direction over riffle members 84, 86 as shown by arrow 158, thereby to produce a solid "green" water flow over riffle members 84, 86, slots 88 and screens 114, 116.

It will be seen that valve 148 provides for selective adjustment of the amount of water flow provided by conduit 132 in order to maintain at all times a layer of green water over riffles 84, 86.

Referring now particularly to FIG. 9, water which falls through apertures 50 in top plate member 34 and water introduced by conduit 132 flows over riffles 84, 86 and expanded metal screens 114, 116, as shown by arrow 160, expanded metal screens 114, 115 serving to slow-down the heavier materials in the water flow. It will be apparent that the heavier material falls through screens 114, 116 into slots 88. A portion of the water flow enters slots 88 as shown by arrow 162, thereby agitating the light particles so that they move upwardly and back into the water stream. It will thus be seen that the heavier materials enter slots 88 between riffle members 84, 86 and are conveyed thereby to trough 68.

Figure 12:
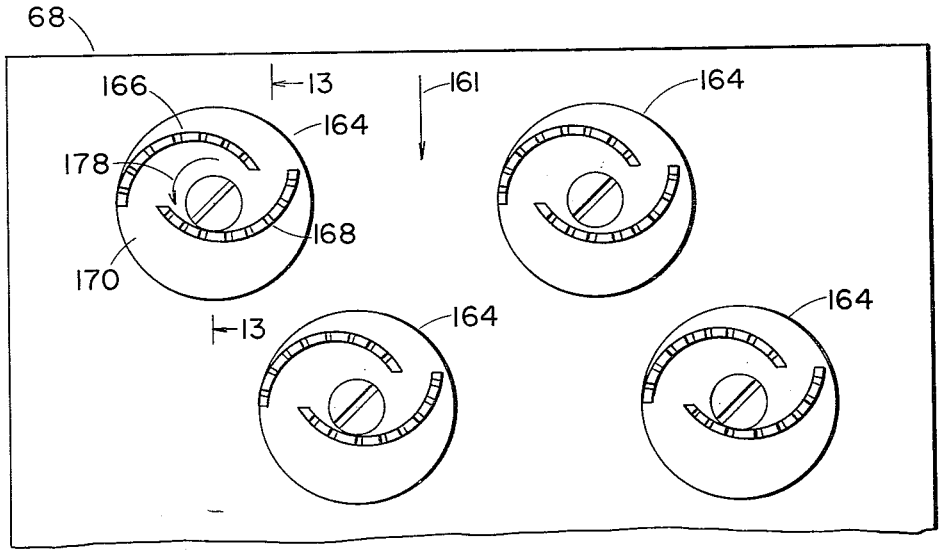
FIG. 12 is an enlarged, fragmentary top view showing the adjustable riffles on the bottom of the trough.
Figure 13:
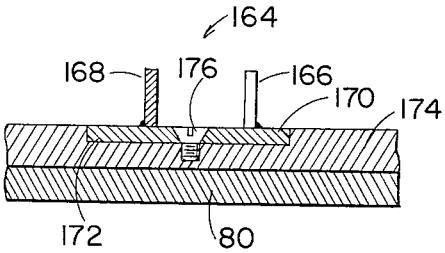
FIG. 13 is a fragmentary cross-sectional view taken generally along the line 13—13 of FIG. 12.
Figure 14:
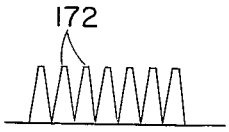
FIG. 14 is a side, developed view of one of the riffles of FIGS. 12 and 13.

Referring now to FIGS. 6 and 12 through 15, a plurality of riffle elements 164 is provided on bottom 80 of trough 68 extending from adjacent upstream end 60 to downstream end 62. Each of the riffle elements 164 comprises a pair of upstanding, semi-circular members 166, 168 secured to circular plate 170. Members 166 are convex in the upstream direction; i.e., facing the water flow as shown by arrow 161, and members 168 are convex in the downstream direction, as best seen in FIG. 12. Riffle members 166, 168 of each riffle element 164 have toothed upper edges 172, as best seen in FIG. 14. Riffle members 166, 168 of each riffle element 164 are laterally displaced, as seen in FIG. 12. Each circular plate 170 with its upstanding, toothed riffle members 166, 168 thereon, is seated in a circular recess 172 in plate 174 supported on bottom 80 of trough 68 and is adjustably secured therein by adjusting screw 176 (FIG. 13). The teeth 172 on riffle members 166, 168 serve to slow down the water flow and the laterally displaced arrangement of riffle elements 166, 168 causes turbulence therebetween, as shown by arrow 178 (FIG. 12), to agitate the lighter weight materials for upward movement into the water flow through trough 68 allowing the heavier elements to flow along the bottom of the trough thence through the weir opening to the sump 198 for reclamation.

Figure 15:
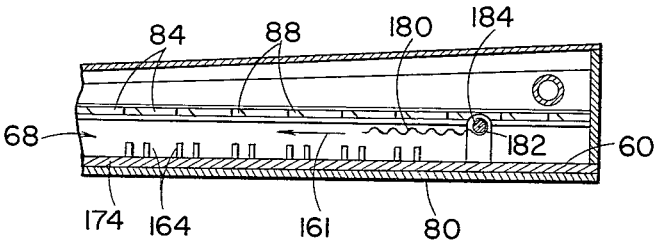
FIG. 15 is a fragmentary cross-sectional view taken generally along the line 15—15 of FIG. 6.

Referring now to FIGS. 6 and 15, a plurality of transversely spaced, elongated ribbon-like flexible agitator elements 90 are provided having upstream ends 182 secured to bar element 184 extending across trough 68 at upstream end 60, ribbon agitator elements extending in the downstream direction over several of the riffle elements 164 adjacent upstream end 60. Ribbon agitator elements vibrate in the downstream water flow in trough 68, as shown by arrow 161, thereby to agitate the flow of water in trough 68 in order to maintain a higher flow of the lighter materials over the riffle elements 164.

Figure 7:
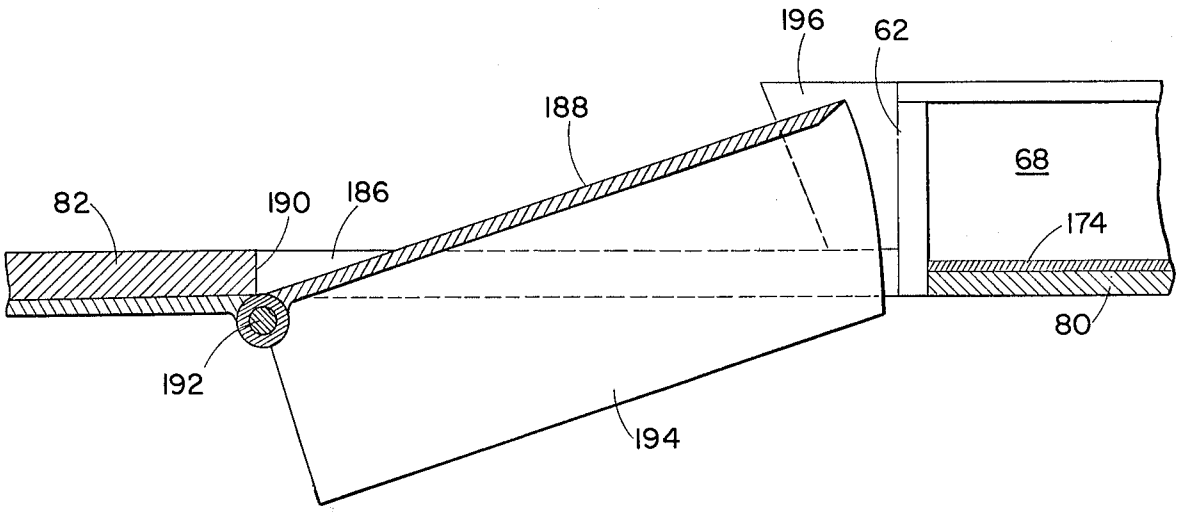
FIG. 7 is a fragmentary cross-sectional view taken generally along the line 7—7 of FIG. 6.

Referring now to FIGS. 2, 6 and 7, rectangular opening 186 is provided in extension 82 of table 58 adjacent downstream end 62 thereof, opening 186 being aligned with downstream end 62 of trough 68. An adjustable weir is pivotally connected to rear edge 190 of opening 186, as at 192 (FIG. 7). Weir 188 has side flanges 194, and a pair of extension plates 196 in essence extend trough 68 in the downstream direction on either side of weir side plates 194. Weir 188 is selectively adjustable between a position completely closing opening 186 so that all material flowing through trough 68 is discharged from table extension 82, and a fully opened position, as shown in FIG. 7, in which the entire cross-sectional area of trough 68 at its downstream end 62 is exposed to opening 186 and to sump portion 198 at the downstream end 32 of cavity 46. Weir 188 is selectively adjusted between its fully closed and fully open positions by means of pitman 200 cooperating with crank 202 on shaft 204. Shaft 204 extends outwardly through slot 206 in side wall 26 and is operated by lever 208. Selective adjustment of the position of adjustable weir 188 provides for removal of heavier sands having the desired weight; i.e., from five to twenty-five pounds per cubic yard in a specific embodiment.

It will now be seen that in the apparatus thus far described, selective adjustment is provided of the pitch or angle of inclination of table 58, the angle of riffle members 84, 86, the amount of additional water flow provided by conduit 132, and the opening of adjustable weir 188, these independent adjustments depending upon:

(1) The size of the heavy material to be recovered;
(2) The amount of heavy material per cubic yard;
(3) The contour of the material being recovered;
(4) The density of the material being recovered that contains economic values of precious metals; and
(5) The water flow.

In normal operation, table 58 has approximately a 10° pitch from its upstream end 60 to its downstream end 62, and is selectively adjustable to between 5° and 20° to the horizontal. Riffle members 84, 86 have a normal inclination with respect to the longitudinal center line of table 58 of about 88° and are adjustable to an inclination of about 86° on order to insure that slots 88 clear properly; a larger amount of heavier material requires a larger angle of inclination for riffle members 84, 86.

Figure 16:
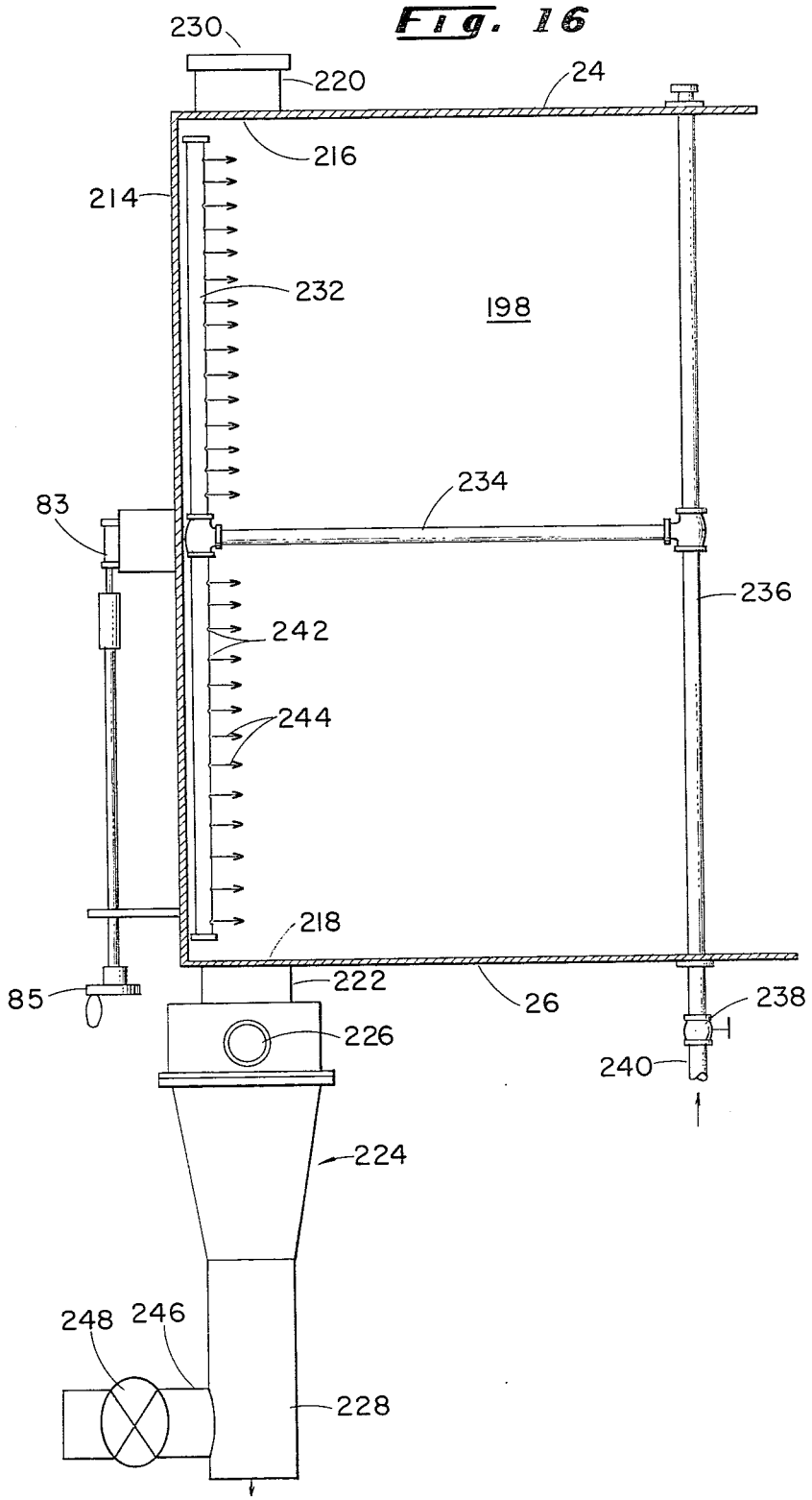
FIG. 16 is a fragmentary cross-sectional view taken generally along the line 16—16 of FIG. 2.

Referring now to FIGS. 1, 2 and 16, sump 196 is defined by sections 210, 212 of bottom wall 28 and front wall 214. Openings 216, 218 are formed in side wall 24, 26 communicating with sump 198 and have short outwardly extending conduit sections 220, 222 connected thereto. Conventional Venturi 224 has its suction tube connected to conduit 222 and source 226 of water under pressure, such as 175 psi, is coupled thereto. It will now be readily understood that upon injecting high pressure water into Venturi 224, the heavy sands accumulated in sump 198 will be sucked therefrom and discharged through discharge tube 228. Cap 230 closes the other conduit 220 section, it being understood that the positions of cap 230 and Venturi 224 may be reversed, as desired.

In the event that the apparatus is shut-down, sump 198 may become filled, thus plugging openings 216 and 218. In order to unplug the system, conduit 232 is provided in sump 198 adjacent front wall 214. Conduit 232 is coupled by means of conduits 234, 236 and valve 238 to source 240 of water under pressure, such as 175 psi. Conduit 232 is supplied with a plurality of apertures 242 for spraying water under pressure into sump 198 as shown by arrows 244. Since the material accumulated in sump 198 under such conditions may be contaminated with lighter material, unplugging discharge connection 246 having valve 248 therein may be connected to discharge tube 228 of Venturi 224, it being understood that during an unplugging operation, another cap 230 is connected to the end of discharge tube 228.

Referring again to FIG. 2, conventional magnet vibrator 250 may be attached to bottom 80 of trough 68, as shown. Vibrator 250 assures continuous movement and more even distribution of materials in trough 68, and aids the rise of lighter materials in the water flow.

It will now be seen that the improved continuous flow classification and specific gravity classification and separation apparatus of the invention is capable of continuous operation, as opposed to other systems which necessitate periodic shut-down for removal of the recovered precious metal. A number of features of the invention cooperate to provide the more efficient recovery of precious metals. The tapered slots 50 and top plate member 34 inhibit binding or clogging of the apertures. It will be observed that the side riffles 84, 86, are inclined from the side walls 24, 26 toward trough 68 in the downstream direction rather than in the upstream direction as in the case of normal sluicing riffles. The center riffles 164, which may be formed of pressed metal, retard the flow of heavy materials, thereby permitting the lighter materials to flow over the top and to be discharged to the tailings by extension 82 of table 58. The agitator ribbons 180 lying in the flow over the recessed center riffles 164 increase agitation of the water flow, thus causing the lighter, non-valuable materials, to rise and to be carried over the tops of the recessed center riffles and over the top of the weir 188 to extension 82 and the tailings, leaving the heavier, valuable sand moving slowly along the bottom 80 of trough 68 to be diverted by weir 188 through opening 186 to sump 198, weir 188 being adjustable to recover the material of any specific gravity desired.

The table 58 is adjustable, from 5° to 20° in the specific embodiment, thus making it possible to coordinate the water flow over the side riffles 84, 86 with the size and shape of the material being recovered. The controlled water flow at the upstream or head end of the table 58 provided by conduit 132 and valve 148 is independent of the water flow entering through apertures 50 in top plate 34, and is used to regulate the water level in the center riffle system 164 in trough 68 to assure an adequate depth of water in connection with the setting of the inclination of table 58 and the desired specific gravity of the material to be recovered.

The peaked baffle 120 over trough 68 equalizes the flow of material entering through apertures 50 in top plate 34. Weir 188 has a wide variety of setting allowing the recovery of any amount of material at any desired specific gravity with the remainder of the lighter materials flowing over the top and being discharged to table extension 82 and advanced to the tailings.

The improved apparatus of the invention permits rapid, continuous, free flow classification and specific gravity separation of fine, heavy materials from minute sizes up to about ¼ inch in diameter in quantities of approximately three pounds per cubic yard of aggregate sluiced at a rate of approximately three cubic yards per minute.

While there have been described above the principles of this invention in connection with specific apparatus, it is to be clearly understood that this description is made only by way of example and not as a limitation to the scope of this invention.

What is claimed is:

1. Continuous flow apparatus for classification and specific gravity separation of relatively fine, heavy sands from gravel and dirt aggregate comprising; an elongated channel structure having spaced, opposite walls, spaced upstream and downstream ends, and a bottom wall; a top plate member spaced from said bottom wall extending laterally between said side walls and longitudinally substantially between said ends, said top plate member having top and bottom surfaces with said bottom surface defining a longitudinally extending cavity with said side and bottom walls, said side walls having portions upstanding from said top surface of said top plate member and defining therewith a flume extending between said ends, said top plate member having at least a portion thereof extending longitudinally toward said downstream end with a plurality of closely-spaced apertures formed therethrough communicating with said cavity; said structure having a back wall extending from said bottom wall to said top plate member and between said side walls at said upstream end; said flume being adapted for the introduction of a flow of water bearing said aggregate adjacent said upstream end for flow over said top surface of said top plate member toward said downstream end whereby the relatively smaller, heavier material forming a part of said aggregate falls through said apertures into said cavity along with some water; a longitudinally extending table in said cavity spaced below said top plate member and inclined downwardly from adjacent said upstream end toward said downstream end, said table having upstream and downstream ends, said table having side edges respectively adjacent said side walls; first means for selectively adjusting the angle of inclination of said table; said table having a trough formed therein extending longitudinally between said table ends intermediate said side edges and respectively defining said portions of said table therewith, said trough having a bottom, said table including an extension portion at said downstream end for discharging tailings from said downstream end, said extension portion extending generally from said trough bottom and having an opening therein adjacent said downstream table end communicating with a sump portion of said cavity disposed below said extension portion for discharging said heavy sands thereto; weir means for diverting flow of a selected heavier portion of the sands at the bottom of said trough through said opening into said cavity sump portion while permitting flow of the remaining lighter portion of said sands over said weir means onto said extension portion; second means for selectively adjusting said weir means thereby to select said heavier sand portion; longitudinally extending baffle means over said trough for diverting material and water falling through said apertures onto said table side portions; riffle means on each of said table side portions under said apertures for receiving said material and water falling through said apertures and separating the heavier material therefrom, said riffle means respectively extending laterally from said side table edges to said trough and being respectively inclined downstream from said side table edges toward said trough for carrying the heavier sands to said trough; third means for selectively adjusting the angle of inclination of said riffle means; means for selectively introducing an additional flow of water into said cavity adjacent said upstream table end and between said table and said top plate member for flow over said riffle means and in said trough toward said downstream table end; and means for removing the separated heavier sands from said cavity sump portion.

2. The apparatus of claim 1 wherein said top plate member comprises a plurality of sections respectively descending longitudinally in step-fashion from said upstream end to said downstream end of said structure, at least one of said sections adjacent said downstream end being imperforate and substantially overlying said table extension portion.

3. The apparatus of claim 1 or claim 2 wherein said apertured portion of said top plate member substantially overlays said table, said apertures being divergently tapered from said top surface to said bottom surface of said top plate member.

4. The apparatus of claim 3 wherein said apertures are transversely elongated.

5. The apparatus of claim 1 further comprising means for respectively pivotally connecting said side edges of said table intermediate said ends thereof to said side walls.

6. The apparatus of claim 5 wherein said first adjusting means acts on said table extension portion.

7. The apparatus of claim 1 wherein said opening is rectangular and has a downstream edge, said weir means comprising a gate pivotally connected to said opening edge for selective movement between a fully closed position closing said opening and a fully open position exposing substantially the entire cross-section area of said trough to said opening.

8. The apparatus of claim 7 wherein said second adjusting means acts on said gate.

9. The apparatus of claim 8 wherein said baffle means is longitudinally peaked with side portions respectively inclined downwardly therefrom toward said side walls and terminating in side edges, said side portion edges being respectively spaced above said riffle means.

10. The apparatus of claim 1 wherein each of said riffle means comprises a plurality of longitudinally spaced, parallel, transversely elongated bars, width of said bars being respectively greater than the width of the spaces between adjacent bars, each of said bars having an outer end adjacent the respective side wall and an inner end adjacent said trough, the spaces between adjacent bars defining channels communicating with said trough for carrying the heavier sands thereto.

11. The apparatus of claim 10 wherein each of said bars is pivotally connected adjacent its inner end to the respective table side portion, said third adjusting means acting on said outer ends of each of said plurality of bars.

12. The apparatus of claim 10 wherein each of said bars has a laterally extending upstream-facing edge which is generally perpendicular to the respective table side portion, and a laterally extending downstream-facing edge which is inclined downwardly in the upstream direction toward the respective table side portion.

13. The apparatus of claim 12 further comprising an expanded metal screen covering each of said plurality of bars.

14. The apparatus of claim 1 further comprising a plurality of riffle means on said trough bottom and spaced therealong from said upstream to said downstream end thereof for creating turbulence in the water flow therein thereby to agitate the lighter weight materials.

15. The apparatus of claim 14 further comprising a plurality of transversely spaced, elongated, ribbon-like flexible elements having ends secured in said trough adjacent said upstream end and extending in the downstream direction over a portion of said last-named riffle means adjacent said upstream end of said trough for agitating the flow of water in said trough thereby to facilitate the flow of lighter materials therein.

16. The apparatus of claim 14 wherein each of said last-named riffle means comprises a pair of upstanding semi-circular members, one said upstanding member of each said pair being convex in the downstream direction, each of said upstanding members having a toothed upper edge.

17. The apparatus of claim 16 wherein each said pair of upstanding members is adjustably secured to said trough bottom for selective rotational movement.

18. The apparatus of claim 1 further comprising fourth means for selectively adjusting the amount of said additional water flow.

19. The apparatus of claim 1 wherein said removing means includes a Venturi having a pressure inlet adapted to be connected to a source of water under pressure.

20. The apparatus of claim 19 further comprising means for introducing water under pressure into said sump to facilitate removing accumulated material therein.

21. The apparatus of claim 20 wherein said last-named introducing means includes means for spraying a plurality of fine jets of water into said sump.

22. The apparatus of claim 1 wherein said additional water flow introducing means comprises a conduit extending laterally across said cavity adjacent said back wall and adapted to have a source of water under pressure connected thereto.

23. The apparatus of claim 1 wherein said top plate member comprises a plurality of sections respectively descending longitudinally in step-fashion from said upstream end to said downstream end of said structure, at least one of said sections adjacent said downstream end and being imperforate and substantially overlaying said table extension portion, said apertured portion of said top plate member substantially overlaying said table, said apertures being transversely elongated and being divergently tapered from said front surface to said bottom surface of said top plate member, said table having said side edges thereof pivotally connected intermediate the ends thereof to said side walls, said weir means comprising a gate movable between a position closing said opening and an open position exposing said trough to said opening, each of said riffle means comprising a plurality of longitudinally spaced, parallel, transversely elongated bars respectively defining slots therebetween communicating with said trough for carrying the heavier sands thereto, said bars being respectively wider than said slots, said slots being generally dovetailed in cross section, and further comprising apertured means covering each of said riffle means for retarding the flow of heavier materials, and means in said trough for agitating the flow of lighter materials therein.

24. The apparatus of claim 1 further comprising means for vibrating said table.

25. The apparatus of claim 24 wherein said vibrating means comprises a magnetic vibrator attached to said trough.

* * * * *